US007886412B2

(12) United States Patent
Dais et al.

(10) Patent No.: US 7,886,412 B2
(45) Date of Patent: Feb. 15, 2011

(54) POUCH AND AIRTIGHT RESEALABLE CLOSURE MECHANISM THEREFOR

(75) Inventors: Brian C. Dais, Saginaw, MI (US); Bryan L. Ackerman, Freeland, MI (US); James C. Pawloski, Bay City, MI (US); Robert R. Turvey, Sanford, MI (US); Daniel Zimmerman, Livonia, MI (US)

(73) Assignee: S.C. Johnson Home Storage, Inc., Racine, WI (US)

( * ) Notice: Subject to any disclaimer, the term of this patent is extended or adjusted under 35 U.S.C. 154(b) by 1005 days.

(21) Appl. No.: 11/725,120

(22) Filed: Mar. 16, 2007

(65) Prior Publication Data

US 2008/0226202 A1 Sep. 18, 2008

(51) Int. Cl.
*A44B 19/16* (2006.01)
*B65D 33/16* (2006.01)

(52) U.S. Cl. ..... 24/585.12; 24/399; 24/DIG. 39; 383/61.2; 383/63

(58) Field of Classification Search ..... 24/399, 24/585.12, DIG. 39; 383/61.2, 63
See application file for complete search history.

(56) References Cited

U.S. PATENT DOCUMENTS 2,576,322 A 11/1951 Waters
2,609,314 A 9/1952 Engel et al.
2,633,442 A 3/1953 Caldwell
2,642,372 A 6/1953 Chittick
2,670,501 A 3/1954 Michiels
2,759,866 A 8/1956 Seymour
2,772,712 A 12/1956 Post
2,776,452 A 1/1957 Chavannes
2,778,171 A 1/1957 Taunton
2,778,173 A 1/1957 Taunton
2,821,338 A 1/1958 Metzger
2,856,323 A 10/1958 Gordon
2,858,247 A 10/1958 De Swart
2,870,954 A 1/1959 Kulesza
2,913,030 A 11/1959 Fisher
2,916,411 A 12/1959 Villoresi
2,927,722 A 3/1960 Metzger
2,960,144 A 11/1960 Graf
3,026,231 A 3/1962 Chavannes
3,060,985 A 10/1962 Vance et al.
3,098,563 A 7/1963 Skees
3,102,676 A 9/1963 Danelli et al.
3,113,715 A 12/1963 Pangrac
3,141,221 A 7/1964 Faults, Jr.
3,142,599 A 7/1964 Chavannes
3,149,772 A 9/1964 Olsson (Continued)

FOREIGN PATENT DOCUMENTS

JP 3294043 5/2002

*Primary Examiner*—Robert J Sandy

(57) ABSTRACT

A pouch has an elongate closure mechanism adapted to provide vacuum retention within an interior of the pouch over an extended period of time when sealed. The closure mechanism includes a first pair of interlocking members that resealably mate together, a second pair of interlocking members that resealably mate together, and a pair of sealing members that form an air tight seal separate from the interlocking members disposed between the first and second pairs of interlocking members. The closure members are connected with opposing panels of the pouch in a manner designed to provide differential opening and closing forces. The pouch may include a check valve and air evacuation channels to aid in evacuating air from the interior.

14 Claims, 1 Drawing Sheet

U.S. PATENT DOCUMENTS

| | | | |
|---|---|---|---|
| 3,160,323 | A | 12/1964 | Weisberg |
| 3,216,172 | A | 11/1965 | Piazze |
| 3,219,084 | A | 11/1965 | Ausnit et al. |
| 3,224,574 | A | 12/1965 | McConnell |
| 3,237,844 | A | 3/1966 | Hughes |
| 3,251,463 | A | 5/1966 | Bodet |
| 3,302,859 | A | 2/1967 | Perry |
| 3,325,084 | A | 6/1967 | Ausnit |
| 3,372,442 | A | 3/1968 | Ishimatsu |
| 3,381,887 | A | 5/1968 | Lowry |
| 3,389,733 | A | 6/1968 | Siegel |
| 3,411,698 | A | 11/1968 | Reynolds |
| 3,440,696 | A | 4/1969 | Staller |
| 3,464,094 | A | 9/1969 | Mates |
| 3,516,217 | A | 6/1970 | Gildersleeve |
| 3,557,413 | A | 1/1971 | Engle |
| 3,565,147 | A | 2/1971 | Ausnit |
| 3,575,781 | A | 4/1971 | Pezely |
| 3,595,467 | A | 7/1971 | Goglio |
| 3,595,722 | A | 7/1971 | Dawbarn |
| 3,608,439 | A | 9/1971 | Ausnit |
| 3,628,720 | A | 12/1971 | Schmedding |
| 3,633,642 | A | 1/1972 | Siegel |
| 3,655,501 | A | 4/1972 | Tesch |
| 3,679,511 | A | 7/1972 | Ausnit |
| 3,746,215 | A | 7/1973 | Ausnit et al. |
| 3,780,781 | A | 12/1973 | Uramoto |
| 3,790,992 | A | 2/1974 | Herz |
| 3,799,427 | A | 3/1974 | Goglio |
| 3,809,217 | A | 5/1974 | Harrison |
| 3,833,166 | A | 9/1974 | Murray |
| 3,918,131 | A | 11/1975 | Ausnit |
| 3,937,396 | A | 2/1976 | Schneider |
| 3,980,226 | A | 9/1976 | Franz |
| 3,989,182 | A | 11/1976 | Stearley |
| 4,000,846 | A | 1/1977 | Gilbert |
| 4,020,884 | A | 5/1977 | Jadot |
| 4,085,886 | A | 4/1978 | Nishioka |
| 4,101,355 | A | 7/1978 | Ausnit |
| 4,105,491 | A | 8/1978 | Haase et al. |
| 4,122,993 | A | 10/1978 | Glas |
| 4,134,535 | A | 1/1979 | Barthels et al. |
| 4,155,453 | A | 5/1979 | Ono |
| 4,186,786 | A | 2/1980 | Kirkpatrick |
| 4,206,870 | A | 6/1980 | DeVries |
| 4,212,337 | A | 7/1980 | Kamp |
| 4,215,725 | A | 8/1980 | Callet et al. |
| 4,246,288 | A | 1/1981 | Sanborn, Jr. |
| 4,310,118 | A | 1/1982 | Kisida et al. |
| 4,332,344 | A | 6/1982 | Strodthoff |
| 4,340,558 | A | 7/1982 | Hendrickson |
| 4,354,541 | A | 10/1982 | Tilman |
| 4,355,494 | A | 10/1982 | Tilman |
| 4,363,345 | A | 12/1982 | Scheibner |
| 4,372,921 | A | 2/1983 | Sanderson et al. |
| 4,426,816 | A | 1/1984 | Dean et al. |
| 4,430,070 | A | 2/1984 | Ausnit |
| 4,449,243 | A | 5/1984 | Platel |
| 4,470,153 | A | 9/1984 | Kenan |
| 4,491,959 | A | 1/1985 | Loefberg |
| 4,509,642 | A | 4/1985 | Rowell |
| 4,524,460 | A | 6/1985 | Twiehoff et al. |
| 4,528,224 | A | 7/1985 | Ausnit |
| 4,532,652 | A | 7/1985 | Herrington |
| 4,541,117 | A | 9/1985 | Ashbeck |
| 4,550,546 | A | 11/1985 | Raley et al. |
| 4,551,379 | A | 11/1985 | Kerr |
| 4,566,131 | A | 1/1986 | Achelpohl |
| 4,576,283 | A | 3/1986 | Fafournoux |
| 4,578,813 | A | 3/1986 | Ausnit |
| 4,581,764 | A | 4/1986 | Plock et al. |
| 4,653,661 | A | 3/1987 | Buchner et al. |
| 4,660,355 | A | 4/1987 | Kristen |
| 4,672,684 | A | 6/1987 | Barnes et al. |
| 4,691,372 | A | 9/1987 | Van Erden |
| 4,691,373 | A | 9/1987 | Ausnit |
| 4,701,358 | A | 10/1987 | Behr et al. |
| 4,702,376 | A | 10/1987 | Pagliaro |
| 4,712,574 | A | 12/1987 | Perrott |
| 4,715,494 | A | 12/1987 | Heitzenröder et al. |
| 4,730,635 | A | 3/1988 | Linden |
| 4,731,911 | A | 3/1988 | Gould |
| 4,736,450 | A | 4/1988 | Van Erden et al. |
| 4,736,451 | A | 4/1988 | Ausnit |
| 4,747,702 | A | 5/1988 | Scheibner |
| 4,752,992 | A | 6/1988 | Kondo et al. |
| 4,756,628 | A | 7/1988 | Branson |
| 4,756,629 | A | 7/1988 | Tilman et al. |
| 4,778,282 | A | 10/1988 | Borchardt et al. |
| 4,780,937 | A | 11/1988 | Kusayama |
| 4,787,754 | A | 11/1988 | Herrington |
| 4,787,755 | A | 11/1988 | Branson |
| 4,787,880 | A | 11/1988 | Ausnit |
| 4,791,710 | A | 12/1988 | Nocek et al. |
| 4,792,240 | A | 12/1988 | Ausnit |
| 4,795,269 | A | 1/1989 | Scheibner |
| 4,796,300 | A | 1/1989 | Branson |
| 4,807,300 | A | 2/1989 | Ausnit et al. |
| 4,812,056 | A | 3/1989 | Zieke |
| 4,812,074 | A | 3/1989 | Ausnit et al. |
| 4,817,188 | A | 3/1989 | Van Erden |
| 4,825,514 | A | 5/1989 | Akeno |
| 4,829,641 | A | 5/1989 | Williams |
| 4,832,505 | A | 5/1989 | Ausnit et al. |
| 4,834,554 | A | 5/1989 | Stetler, Jr. et al. |
| 4,840,611 | A | 6/1989 | Van Erden et al. |
| 4,841,603 | A | 6/1989 | Ragni |
| 4,858,286 | A | 8/1989 | Siegel |
| 4,859,259 | A | 8/1989 | Scheibner |
| 4,863,286 | A | 9/1989 | Branson |
| 4,869,725 | A | 9/1989 | Schneider et al. |
| 4,875,259 | A | 10/1989 | Appeldorn |
| 4,877,334 | A | 10/1989 | Cope |
| 4,878,763 | A | 11/1989 | Ausnit |
| 4,890,637 | A | 1/1990 | Lamparter |
| 4,890,935 | A | 1/1990 | Ausnit et al. |
| 4,892,414 | A | 1/1990 | Ausnit |
| 4,903,718 | A | 2/1990 | Sullivan |
| 4,907,321 | A * | 3/1990 | Williams ..... 24/585.12 |
| 4,909,017 | A | 3/1990 | McMahon et al. |
| 4,923,701 | A | 5/1990 | VanErden |
| 4,925,318 | A | 5/1990 | Sorenson |
| 4,928,829 | A | 5/1990 | Di Bernardo |
| 4,929,487 | A | 5/1990 | Tilman et al. |
| 4,930,904 | A | 6/1990 | Gröner et al. |
| 4,947,525 | A | 8/1990 | Van Erden |
| 4,953,708 | A | 9/1990 | Beer et al. |
| 4,961,944 | A | 10/1990 | Matoba et al. |
| 4,964,739 | A | 10/1990 | Branson et al. |
| 4,966,470 | A | 10/1990 | Thompson et al. |
| 4,985,192 | A | 1/1991 | Roeder et al. |
| 5,007,143 | A | 4/1991 | Herrington |
| 5,009,318 | A | 4/1991 | Lepinoy |
| 5,012,561 | A | 5/1991 | Porchia et al. |
| 5,017,021 | A | 5/1991 | Simonsen et al. |
| 5,022,530 | A | 6/1991 | Zieke |
| RE33,674 | E | 8/1991 | Uramoto |
| 5,037,138 | A | 8/1991 | McClintock et al. |
| 5,044,774 | A | 9/1991 | Bullard et al. |
| 5,053,091 | A | 10/1991 | Giljam et al. |
| 5,056,933 | A | 10/1991 | Kamp |
| 5,059,036 | A | 10/1991 | Richison et al. |
| 5,067,208 | A | 11/1991 | Herrington, Jr. et al. |
| 5,067,822 | A | 11/1991 | Wirth et al. |

5,070,584 A 12/1991 Dais et al.
5,088,162 A 2/1992 Allan
5,088,971 A 2/1992 Herrington
5,092,684 A 3/1992 Weeks
5,119,531 A 6/1992 Berger et al.
5,140,727 A 8/1992 Dais et al.
5,140,796 A 8/1992 Pope
5,141,577 A 8/1992 Porchia et al.
5,142,970 A 9/1992 ErkenBrack
5,167,454 A 12/1992 Woods et al.
5,168,586 A 12/1992 Small
5,170,990 A 12/1992 Kamiya et al.
5,174,658 A 12/1992 Cook et al.
5,179,767 A 1/1993 Allan
5,186,543 A 2/1993 Cochran
5,188,461 A 2/1993 Sorenson
5,189,764 A 3/1993 Herrington et al.
5,192,135 A 3/1993 Woods et al.
5,198,055 A 3/1993 Wirth et al.
5,203,458 A 4/1993 Cornwell
5,209,264 A 5/1993 Koyanagi
5,209,574 A 5/1993 Tilman
5,211,481 A 5/1993 Tilman
5,212,855 A 5/1993 McGanty
5,216,787 A 6/1993 Custer et al.
5,228,271 A 7/1993 Wallace
5,235,731 A 8/1993 Anzai et al.
5,238,306 A 8/1993 Heintz et al.
5,240,112 A 8/1993 Newburger
5,242,516 A 9/1993 Custer et al.
5,246,114 A 9/1993 Underwood
5,248,201 A 9/1993 Kettner et al.
5,252,281 A 10/1993 Kettner et al.
5,252,379 A 10/1993 Kuribayashi et al.
5,263,777 A 11/1993 Domke
5,272,794 A 12/1993 Hamatani et al.
5,283,932 A 2/1994 Richardson et al.
RE34,554 E 3/1994 Ausnit
5,293,672 A 3/1994 Tominaga et al.
5,301,394 A 4/1994 Richardson et al.
5,301,395 A 4/1994 Richardson et al.
5,326,176 A 7/1994 Domke
5,332,095 A 7/1994 Wu
5,333,736 A 8/1994 Kawamura
5,339,602 A 8/1994 Landers et al.
5,339,959 A 8/1994 Cornwell
5,351,369 A 10/1994 Swain
5,351,828 A 10/1994 Becker et al.
5,354,133 A 10/1994 Rapparini
5,356,222 A 10/1994 Kettner et al.
5,366,294 A 11/1994 Wirth et al.
5,368,394 A 11/1994 Scott et al.
5,369,847 A 12/1994 Naya et al.
5,371,925 A 12/1994 Sawatsky
5,384,942 A 1/1995 Siegel
5,388,910 A 2/1995 Koyanagi
5,397,182 A 3/1995 Gaible et al.
5,399,022 A 3/1995 Sheets
5,403,094 A 4/1995 Tomic
5,407,087 A 4/1995 Giblin et al.
RE34,929 E 5/1995 Kristen
5,415,904 A 5/1995 Takubo et al.
5,417,035 A 5/1995 English
5,417,495 A 5/1995 Branson
5,419,638 A 5/1995 Jamison
5,435,864 A 7/1995 Machacek et al.
5,443,851 A 8/1995 Christie et al.
5,445,870 A 8/1995 Buchner et al.
5,448,807 A 9/1995 Herrington, Jr.
5,450,963 A 9/1995 Carson
5,462,473 A 10/1995 Sheller
5,469,966 A 11/1995 Boyer
5,480,030 A 1/1996 Sweeney et al.
5,492,241 A 2/1996 Barnett et al.
5,494,165 A 2/1996 Detrick
5,509,734 A 4/1996 Ausnit
5,511,884 A 4/1996 Bruno et al.
5,520,463 A 5/1996 Tilman
5,523,236 A 6/1996 Nuzzo
5,525,363 A 6/1996 Herber et al.
5,526,843 A 6/1996 Wolf et al.
5,540,500 A 7/1996 Tanaka
5,540,557 A 7/1996 Carson
5,542,902 A 8/1996 Richison et al.
5,544,752 A 8/1996 Cox
5,549,944 A 8/1996 Abate
5,551,127 A 9/1996 May
5,553,942 A 9/1996 Domke et al.
5,554,423 A 9/1996 Abate
5,558,439 A 9/1996 Tilman
5,558,613 A 9/1996 Tilman et al.
5,566,429 A 10/1996 Martinez et al.
5,573,614 A * 11/1996 Tilman et al. ..... 156/66
5,577,305 A 11/1996 Johnson
5,584,409 A 12/1996 Chemberlen
5,587,192 A 12/1996 Beizermann
5,588,187 A 12/1996 Swain
5,592,697 A 1/1997 Young
5,603,995 A 2/1997 Takubo et al.
5,609,420 A 3/1997 Palmisano
5,618,111 A 4/1997 Porchia et al.
5,622,431 A 4/1997 Simonsen
5,628,566 A 5/1997 Schreiter
5,638,971 A 6/1997 Justesen
5,653,251 A 8/1997 Handler
5,655,273 A 8/1997 Tomic et al.
5,655,842 A 8/1997 Hagino
5,660,479 A 8/1997 May et al.
5,664,303 A 9/1997 Johnson
5,669,715 A 9/1997 Dobreski et al.
5,672,009 A 9/1997 Malin
5,689,866 A 11/1997 Kasai et al.
5,699,838 A 12/1997 Catallo et al.
5,700,091 A 12/1997 Tanaka et al.
5,701,996 A 12/1997 Goto et al.
5,709,479 A 1/1998 Bell
5,713,669 A 2/1998 Thomas et al.
5,718,024 A 2/1998 Robbins
5,729,876 A 3/1998 Johnson
5,735,317 A 4/1998 Wu
5,735,395 A 4/1998 Lo
5,749,493 A 5/1998 Boone et al.
5,749,658 A 5/1998 Kettner
5,769,772 A 6/1998 Wiley
5,774,954 A 7/1998 Ramsey et al.
5,775,812 A 7/1998 St. Phillips et al.
5,782,562 A 7/1998 Anspacher
5,782,733 A 7/1998 Yeager
5,784,862 A 7/1998 Germano
5,791,783 A 8/1998 Porchia et al.
5,794,315 A 8/1998 Crabtree et al.
5,827,163 A 10/1998 Kettner
5,829,884 A 11/1998 Yeager
5,833,791 A 11/1998 Bryniarski et al.
5,839,582 A 11/1998 Strong et al.
5,839,831 A 11/1998 Mazzocchi
5,839,832 A 11/1998 Hagino
5,855,498 A 1/1999 Spector
5,871,281 A 2/1999 Stolmeier et al.
5,874,155 A 2/1999 Gehrke et al.
5,875,611 A 3/1999 Plourde
5,881,881 A 3/1999 Carrington
5,882,120 A 3/1999 Bell
5,893,461 A 4/1999 Walters
5,893,645 A 4/1999 May
5,894,929 A 4/1999 Kai et al.

5,898,113 A 4/1999 Vecere
5,902,046 A 5/1999 Shibata
5,902,047 A 5/1999 Yeager
5,911,508 A 6/1999 Dobreski et al.
5,915,596 A 6/1999 Credle, Jr.
5,919,535 A 7/1999 Dobreski et al.
5,924,173 A 7/1999 Dobreski et al.
5,924,795 A 7/1999 Thompson et al.
5,927,336 A 7/1999 Tanaka et al.
5,927,855 A 7/1999 Tomic et al.
5,928,762 A 7/1999 Aizawa et al.
5,930,877 A 8/1999 Thorpe et al.
5,931,189 A 8/1999 Sweeney et al.
5,931,582 A 8/1999 Nichols
5,933,927 A 8/1999 Miller et al.
5,941,421 A 8/1999 Overman et al.
5,941,643 A 8/1999 Linkiewicz
5,944,425 A 8/1999 Forman
5,947,603 A 9/1999 Tilman
5,951,453 A 9/1999 Yeager
5,953,796 A 9/1999 McMahon et al.
5,954,196 A 9/1999 Lin
5,954,433 A 9/1999 Yeager
5,956,815 A 9/1999 O'Connor et al.
5,964,532 A 10/1999 St. Phillips et al.
5,967,664 A 10/1999 Giles et al.
5,983,466 A 11/1999 Petkovsek
5,988,426 A 11/1999 Stern
5,988,880 A 11/1999 Tomic
5,989,608 A 11/1999 Mizuno
5,992,442 A 11/1999 Urquhart et al.
5,992,635 A 11/1999 Walters
5,996,800 A 12/1999 Pratt
6,004,032 A 12/1999 Kapperman et al.
6,009,603 A 1/2000 Gallagher
6,010,244 A 1/2000 Dobreski et al.
6,012,264 A 1/2000 Linkiewicz
6,014,795 A 1/2000 McMahon et al.
6,017,412 A 1/2000 Van Erden et al.
6,019,512 A 2/2000 Yeager
6,021,624 A 2/2000 Richison et al.
6,023,914 A 2/2000 Richison et al.
6,029,810 A 2/2000 Chen
6,030,122 A 2/2000 Ramsey et al.
6,033,113 A 3/2000 Anderson
6,039,182 A 3/2000 Light
6,044,621 A 4/2000 Malin et al.
6,045,264 A 4/2000 Miniea
6,045,546 A 4/2000 Drago et al.
6,047,450 A 4/2000 Machacek et al.
6,056,439 A 5/2000 Graham
6,059,456 A 5/2000 May
6,059,457 A 5/2000 Spreche et al.
6,068,898 A 5/2000 Oyama
6,070,397 A 6/2000 Bachhuber
6,070,728 A 6/2000 Overby et al.
6,071,011 A 6/2000 Thomas et al.
6,074,096 A 6/2000 Tilman
6,076,967 A 6/2000 Beaudette
6,080,252 A 6/2000 Plourde
6,082,897 A 7/2000 Galomb
6,085,906 A 7/2000 Lambert
6,085,922 A 7/2000 Esser
6,092,931 A 7/2000 Tilman
6,110,586 A 8/2000 Johnson
6,112,374 A 9/2000 Van Erden
6,116,781 A 9/2000 Skeens
6,120,817 A 9/2000 Archibald et al.
6,126,013 A 10/2000 Miller
6,126,975 A 10/2000 Archibald et al.
6,132,089 A 10/2000 Galomb et al.
6,138,329 A 10/2000 Johnson
6,148,588 A 11/2000 Thomas et al.
6,149,302 A 11/2000 Taheri
6,149,304 A 11/2000 Hamilton et al.
6,152,601 A 11/2000 Johnson
6,164,825 A 12/2000 Larkin et al.
6,167,597 B1 1/2001 Malin
6,170,985 B1 1/2001 Shabram, Jr. et al.
6,176,613 B1 1/2001 Chen
6,177,172 B1 1/2001 Yeager
6,178,602 B1 1/2001 Burke et al.
6,182,337 B1 2/2001 Machacek et al.
6,182,850 B1 2/2001 Marbler et al.
6,185,796 B1 2/2001 Ausnit
6,194,011 B1 2/2001 Glaser
6,202,849 B1 3/2001 Graham
6,209,287 B1 4/2001 Thieman
6,217,216 B1 4/2001 Taheri
6,220,754 B1 4/2001 Stiglic et al.
6,224,262 B1 5/2001 Hogan et al.
6,227,706 B1 5/2001 Tran
6,231,236 B1 5/2001 Tilman
6,240,941 B1 6/2001 Small et al.
6,244,021 B1 6/2001 Ausnit et al.
6,244,748 B1 6/2001 Kasai et al.
6,257,763 B1 7/2001 Stolmeier et al.
6,270,257 B1 8/2001 Yeager
6,273,609 B1 8/2001 Johnson
6,274,181 B1 8/2001 Richison et al.
6,279,298 B1 8/2001 Thomas et al.
6,286,191 B2 9/2001 Van Erden
6,286,999 B1 9/2001 Cappel et al.
6,287,001 B1 9/2001 Buchman
6,289,561 B1 9/2001 Provan et al.
6,290,391 B1 9/2001 Buchman
6,290,392 B1 9/2001 Sandor
6,292,986 B1 9/2001 Provan et al.
6,293,701 B1 9/2001 Tomic
6,299,353 B1 10/2001 Piechocki et al.
6,299,720 B1 10/2001 Van Erden
6,317,939 B1 11/2001 Malin
6,321,423 B1 11/2001 Johnson
6,334,711 B1 1/2002 Risgalla et al.
6,345,911 B1 2/2002 Young et al.
6,347,437 B2 2/2002 Provan et al.
6,354,738 B1 3/2002 Buckman et al.
6,357,915 B2 3/2002 Anderson
6,361,209 B1 3/2002 LaRue et al.
6,361,211 B1 3/2002 Tilman
6,361,212 B1 3/2002 Sprehe et al.
6,364,530 B1 4/2002 Buchman
6,371,643 B2 4/2002 Saad et al.
6,371,644 B1 4/2002 Forman
6,374,855 B1 4/2002 Hansen
6,376,035 B1 4/2002 Dobreski et al.
6,378,272 B1 4/2002 Archibald et al.
6,385,818 B1 5/2002 Savicki, Sr.
6,386,760 B1 5/2002 Tomic
6,402,375 B1 6/2002 Schreiter et al.
6,403,174 B1 6/2002 Copeta
6,408,872 B1 6/2002 Skeens et al.
6,439,771 B1 8/2002 Herrington, Jr.
6,450,686 B1 9/2002 May
6,461,042 B1 10/2002 Tomic et al.
6,468,332 B2 10/2002 Goglio et al.
6,481,889 B2 11/2002 Delsahut
6,481,890 B1 11/2002 VandenHeuvel
6,487,758 B2 12/2002 Shaffer et al.
6,489,022 B1 12/2002 Hamilton et al.
6,491,166 B1 12/2002 Compton et al.
6,491,433 B2 12/2002 Shabram, Jr. et al.
6,499,878 B1 12/2002 Dobreski et al.
6,499,879 B2 12/2002 Schneck
6,505,383 B2 1/2003 Machacek et al.
6,513,659 B1 2/2003 Ogura et al.

6,517,242 B1 2/2003 Buchman
6,524,002 B2 2/2003 Tomic
6,526,632 B1 3/2003 Blythe et al.
6,527,003 B1 3/2003 Webster
6,530,870 B2 3/2003 Buchman et al.
6,533,456 B1 3/2003 Buchman
D473,761 S 4/2003 Wilk et al.
6,539,594 B1 4/2003 Kasai et al.
6,550,965 B2 4/2003 Shaffer et al.
6,568,046 B1 5/2003 Savicki et al.
6,571,430 B1 6/2003 Savicki et al.
6,572,267 B1 6/2003 Forman
6,575,191 B2 6/2003 Skeens et al.
6,581,253 B2 6/2003 ErkenBrack
6,581,641 B2 6/2003 Skeens et al.
6,595,689 B1 7/2003 Borchardt et al.
D478,774 S 8/2003 Wilk et al.
6,602,580 B1 8/2003 Hamilton et al.
6,604,634 B2 8/2003 Su
6,609,353 B1 8/2003 McMahon et al.
6,609,827 B2 8/2003 Bois et al.
6,611,996 B2 9/2003 Blythe et al.
6,622,857 B2 9/2003 Ohtsubo et al.
6,632,021 B2 10/2003 Bois et al.
6,634,384 B2 10/2003 Skeens et al.
6,637,939 B2 10/2003 Huffer
6,659,643 B2 12/2003 Plourde et al.
6,662,827 B1 12/2003 Clougherty et al.
6,663,284 B2 12/2003 Buckingham et al.
6,666,580 B2 12/2003 Bois
6,675,982 B2 1/2004 Heil et al.
6,679,027 B2 1/2004 Schreiter
6,691,383 B2 2/2004 Linton
6,692,147 B2 2/2004 Nelson
6,694,704 B1 2/2004 Ausnit
6,698,925 B2 3/2004 Bentsen
6,712,334 B2 3/2004 Motonaka et al.
6,712,509 B2 3/2004 Cappel
6,713,152 B2 3/2004 Chen et al.
6,715,644 B2 4/2004 Wilford
6,721,999 B2 4/2004 Meager
6,729,473 B2 5/2004 Anderson
6,739,755 B2 5/2004 Schreiter
6,755,568 B2 6/2004 Malone et al.
6,767,131 B2 7/2004 Taheri
6,773,163 B2 8/2004 Ichikawa et al.
6,780,146 B2 8/2004 Thomas et al.
6,786,641 B2 9/2004 Plourde
6,789,690 B2 9/2004 Nieh et al.
6,796,933 B2 9/2004 Bois
6,799,680 B2 10/2004 Mak
6,799,890 B2 10/2004 Schneider et al.
6,810,642 B2 11/2004 Cortigiano, Sr.
6,817,763 B2 11/2004 Tomic
6,821,589 B2 11/2004 Dobreski et al.
6,826,808 B2 12/2004 Kutschka
6,827,105 B1 12/2004 Marble et al.
6,827,492 B2 12/2004 Cook
6,830,377 B2 12/2004 Schneider
6,835,257 B2 12/2004 Perrine
6,837,268 B2 1/2005 Skeens et al.
6,845,598 B1 1/2005 Melchoir
6,846,107 B2 1/2005 Sweeney et al.
6,851,248 B2 2/2005 Knight et al.
6,854,886 B2 2/2005 Piechocki et al.
6,862,980 B2 3/2005 Heil et al.
6,874,935 B2 4/2005 Edelman et al.
6,874,937 B2 4/2005 Ausnit
6,874,938 B2 4/2005 Price et al.
6,877,898 B2 4/2005 Berich et al.
6,883,665 B1 4/2005 Ahn
6,884,207 B2 4/2005 Pokusa
6,901,637 B2 6/2005 Machacek
6,910,805 B2 6/2005 Johnson
6,910,806 B2 6/2005 Strand et al.
6,913,387 B2 7/2005 Strand et al.
6,925,688 B1 8/2005 Savicki
6,932,509 B2 8/2005 Shah et al.
6,945,392 B2 9/2005 Furukawa et al.
6,954,969 B1 10/2005 Sprehe
6,955,465 B2 10/2005 Machacek et al.
6,964,519 B2 11/2005 ErkenBrack
6,974,256 B2 12/2005 Kinigakis et al.
6,976,669 B2 12/2005 Van Zijll Langhout et al.
6,983,845 B2 1/2006 Shah et al.
6,984,278 B2 1/2006 Anderson et al.
6,988,828 B2 1/2006 Linneweil
6,991,109 B1 1/2006 Shannon et al.
6,993,886 B2 2/2006 Johnson
6,996,879 B1 2/2006 Savicki
7,004,209 B2 2/2006 Davis et al.
7,004,632 B2 2/2006 Hamilton et al.
7,011,615 B2 3/2006 Price et al.
7,022,058 B2 4/2006 Lee
7,036,988 B2 5/2006 Olechowski
7,048,136 B2 5/2006 Havens et al.
7,051,762 B2 5/2006 Haamer
7,077,570 B2 7/2006 Fukumori et al.
7,087,130 B2 8/2006 Wu et al.
7,090,397 B2 8/2006 Stolmeier
7,090,398 B2 8/2006 Shibata
7,096,893 B2 8/2006 Vilalta et al.
7,097,359 B2 8/2006 Plourde et al.
7,108,147 B2 9/2006 Cheung
7,131,550 B2 11/2006 Vilalta et al.
7,138,025 B2 11/2006 Wu et al.
7,162,779 B2 1/2007 MacHacek
7,163,338 B2 1/2007 McCracken et al.
7,178,555 B2 2/2007 Engel et al.
7,461,434 B2 * 12/2008 Ackerman ..... 24/585.12
7,574,781 B2 * 8/2009 Ackerman et al. ..... 24/399
7,784,160 B2 * 8/2010 Dais et al. ..... 24/585.12
2001/0034999 A1 11/2001 Xiong et al.
2002/0090151 A1 7/2002 Skeens et al.
2002/0097923 A1 7/2002 Dobreski et al.
2002/0124471 A1 9/2002 Anderson et al.
2002/0168118 A1 11/2002 Price
2002/0168119 A1 11/2002 Herrington, Jr.
2003/0016887 A1 1/2003 Su
2003/0024847 A1 2/2003 Malaspina
2003/0053722 A1 3/2003 Eggermont
2003/0095727 A1 5/2003 Leighton
2003/0102245 A1 6/2003 Wang
2003/0116466 A1 6/2003 Goto
2003/0118253 A1 6/2003 Machacek
2003/0136798 A1 7/2003 Wilford
2003/0169948 A1 9/2003 Fenzl et al.
2003/0219174 A1 11/2003 Piechocki
2003/0219177 A1 11/2003 Salvaro
2003/0223654 A1 12/2003 Gerrits
2004/0000336 A1 1/2004 Goglio
2004/0000503 A1 1/2004 Shah et al.
2004/0001651 A1 1/2004 Pawloski
2004/0007494 A1 1/2004 Popeil et al.
2004/0014579 A1 1/2004 Sweeney et al.
2004/0022457 A1 2/2004 Brown et al.
2004/0040961 A1 3/2004 Vilalta et al.
2004/0049896 A1 3/2004 Savicki
2004/0050745 A1 3/2004 Lee et al.
2004/0057636 A1 3/2004 Ishizaki
2004/0078939 A1 4/2004 Pawloski
2004/0081375 A1 4/2004 Pokusa
2004/0091185 A1 5/2004 Shibata
2004/0091186 A1 5/2004 Shibata
2004/0098845 A1 5/2004 Fukumori et al.
2004/0114837 A1 6/2004 Koyanagi 2004/0136617 A1 7/2004 Gerrits
2004/0136618 A1 7/2004 Ausnit et al.
2004/0165794 A1 8/2004 Plourde et al.
2004/0177595 A1 9/2004 Kozak
2004/0208400 A1 10/2004 Linneweil
2004/0211698 A1 10/2004 Mak
2004/0223667 A1 11/2004 Shah et al.
2004/0234170 A1 11/2004 Pawloski et al.
2004/0252915 A1 12/2004 Nelson
2004/0256050 A1 12/2004 Wu
2005/0008266 A1 1/2005 Crunkleton et al.
2005/0022472 A1 2/2005 Brakes et al.
2005/0025394 A1 2/2005 Kinigakis et al.
2005/0029704 A1 2/2005 Wu et al.
2005/0034425 A1 2/2005 Johnson
2005/0034806 A1 2/2005 Wu et al.
2005/0034807 A1 2/2005 Wu et al.
2005/0035020 A1 2/2005 Wu et al.
2005/0036717 A1 2/2005 Wu et al.
2005/0036718 A1 2/2005 Wu et al.
2005/0036719 A1 2/2005 Wu et al.
2005/0037164 A1 2/2005 Wu et al.
2005/0061812 A1 3/2005 Vilalta et al.
2005/0063620 A1 3/2005 Anderson
2005/0065007 A1 3/2005 Wu et al.
2005/0069229 A1 3/2005 McCracken et al.
2005/0103798 A1 5/2005 Luigi
2005/0135710 A1 6/2005 Melchoir
2005/0147330 A1 7/2005 Lee
2005/0172577 A1 8/2005 Oltrogge
2005/0190995 A1 9/2005 Koyanagi
2005/0196076 A1 9/2005 Tanaka et al.
2005/0205455 A1 9/2005 Harrison
2005/0220373 A1 10/2005 Wu
2005/0220374 A1 10/2005 Thomas et al.
2005/0229365 A1 10/2005 Offa-Jones
2005/0235468 A1 10/2005 Borchardt et al.
2005/0238263 A1 10/2005 Ping
2005/0244083 A1 11/2005 McMahon et al.
2005/0245376 A1 11/2005 Savicki et al.
2005/0251973 A1 11/2005 Sprehe
2005/0259895 A1 11/2005 Kozak
2005/0271308 A1 12/2005 Pawloski
2005/0276524 A1 12/2005 Taheri
2005/0281489 A1 12/2005 Yeh et al.
2005/0281490 A1 12/2005 Schneider et al.
2005/0281493 A1 12/2005 Heinemeier et al.
2005/0281494 A1 12/2005 Allen et al.
2005/0282695 A1 12/2005 Yeager
2005/0286808 A1 12/2005 Zimmerman et al.
2005/0286810 A1 12/2005 Sprague et al.
2005/0286811 A1 12/2005 Sprague et al.
2005/0286812 A1 12/2005 Sprague et al.
2005/0286813 A1 12/2005 Borchardt
2005/0286817 A1 12/2005 Hall et al.
2006/0008185 A1 1/2006 Borchardt
2006/0008187 A1 1/2006 Armstrong
2006/0013514 A1 1/2006 Wu
2006/0029299 A1 2/2006 Share et al.
2006/0030472 A1 2/2006 Hartman et al.
2006/0034551 A1 2/2006 Linneweil
2006/0035777 A1 2/2006 Johnson
2006/0048483 A1 3/2006 Tilman et al.
2006/0050999 A1 3/2006 Blythe et al.
2006/0053749 A1 3/2006 Scanlan
2006/0072860 A1 4/2006 Wu
2006/0073291 A1 4/2006 Wu
2006/0076058 A1 4/2006 Rypstra
2006/0093242 A1 5/2006 Anzini et al.
2006/0104548 A1 5/2006 Schreiter
2006/0110079 A1 5/2006 Zimmerman et al.
2006/0111226 A1 5/2006 Anzini et al.
2006/0120632 A1 6/2006 Han
2006/0131328 A1 6/2006 Anderson
2006/0157140 A1 7/2006 Bergman et al.
2006/0159372 A1 7/2006 Plourde et al.
2006/0159576 A1 7/2006 Bergman et al.
2006/0165316 A1 7/2006 Cheung
2006/0177156 A1 8/2006 Owen et al.
2006/0179620 A1 8/2006 MacHacek
2006/0182371 A1 8/2006 Borchardt
2006/0193540 A1 8/2006 Borchardt
2006/0201576 A1 9/2006 Domenig
2006/0225787 A1 10/2006 Newrones et al.
2006/0228057 A1 10/2006 Newrones et al.
2006/0263497 A1 11/2006 Hoffman
2006/0283148 A1 12/2006 Zimmermann et al.
2006/0292322 A1 12/2006 Nakajima et al.
2007/0090109 A1 4/2007 Gustavsson
2007/0130733 A1 6/2007 Kasai
2007/0154118 A1 7/2007 Tilman et al.
2007/0172157 A1 7/2007 Buchman

* cited by examiner

POUCH AND AIRTIGHT RESEALABLE CLOSURE MECHANISM THEREFOR

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present invention relates generally to a resealable closure mechanism, such as may be used on a thermoplastic pouch.

2. Description of the Background of the Invention

Thermoplastic pouches having one or more resealable closure mechanisms extending along an opening into an interior thereof are often used to store perishable contents, such as food. In order to keep the food stored inside the pouch fresh for an extended period, users may press excess air out of the bag before completely sealing the closure mechanism. Other pouches have been developed that have a separate air evacuation route so that air may be removed from the pouch after the closure mechanism has already been sealed. Some such pouches allow a vacuum to be formed inside the pouch and then be sealed so as to vacuum pack the contents of the pouch.

Special resealable closure mechanisms have been used in an attempt to maintain the vacuum in the pouch over extended periods of time. Those closure mechanisms include two opposing closure elements that form an interlocking section and a sealing section in an attempt to form an airtight seal. For example, in some such closure mechanisms, one closure element includes a sealing member spaced between two in-turned hooks and the other closure element includes a channel defined by and between two out-turned hooks. The sealing member abuts against inside surfaces of the out-turned hooks to form a seal therewith.

In other such closure mechanisms, each closure element includes a sealing member disposed between two interlocking members. The sealing members press against each other when the interlocking members are appropriately interlocked to form the seal. In one closure mechanism, for example, one closure element includes two spaced out-turned male hooks that interlock with two complementary in-turned female hooks. A pressing rib spaced between the out-turned male hooks is wedged into a tapered channel defined by two tightening walls spaced between the in-turned female hooks. Each tightening wall also presses against an inner surface of the adjacent out-turned male hook.

In another closure mechanism, one closure element has two interlocking bulbous members spaced between two asymmetrical arrow-shaped members projecting from one base. The other closure element has three interlocking bulbous members spaced between two interlocking groove elements projecting from another base. The closure elements resealably mate with each asymmetrical arrow-shaped member interlocked with the opposing groove element and the two interlocking bulbous members on the one closure element engaged in a tight interfering fit between successive ones of the interlocking bulbous members on the other closure element sufficient to form a vacuum seal therebetween. One of the closure elements has a backing member that may be attached directly to a bag wall, and the other closure element has a backing member that is attached at only one end to another flange element that may be attached directly to a bag wall.

SUMMARY OF THE INVENTION

According to one aspect of the invention, an airtight resealable closure mechanism having an elongate profile extending between a first end and a second end includes a first closure element and a second closure element. The first closure element has a first interlocking member, a second interlocking member, and a first sealing member, each protruding from a first base member. The first sealing member is disposed between the first and second interlocking members. The second closure element has a third interlocking member, a fourth interlocking member, and a second sealing member, each protruding from a second base member. The second sealing member forms a tapered channel and is disposed between the third and fourth interlocking members. The first and second interlocking members are resealably interlocked with the third and fourth interlocking members, respectively, and the first sealing member is wedged into the tapered channel of the second sealing member, wherein an airtight seal is formed. The first and second sealing members are spaced from each of the first, second, third, and fourth, interlocking members.

According to another aspect of the invention, a resealable airtight closure mechanism includes a first elongate profile resealably interlocked with a second elongate profile, wherein each elongate profile extends longitudinally between two ends. The first profile includes a first sealing wall spaced between an arrow-shaped first male interlocking member and a channel-shaped first female interlocking member, each projecting from one side of a first base member. The second profile includes a first sealing rib and a second sealing rib spaced between a channel-shaped second female interlocking member and an arrow-shaped second male interlocking member, each projecting from one side of a second base member. Each sealing rib includes a bulbous head spaced from the first base member. The first male interlocking member is interlocked with the second female interlocking member and the first female interlocking member is interlocked with the second male interlocking member. Also, the sealing wall is wedged between first sealing rib and the second sealing rib, whereby an airtight seal is formed between the sealing wall and each bulbous head.

According to yet another aspect of the present invention, a resealable pouch includes a front panel connected with a back panel along a peripheral edge to define a sealable interior space therebetween, and an opening is defined between the front and back panels along a top edge. A first elongate closure profile extends along the front panel proximate the opening, and a second elongate closure profile extends along the back panel proximate the opening. The first closure profile is releasably interlockable with the second closure profile to seal and unseal the opening. Further, the first closure profile includes a sealing member spaced between a first interlocking member and a second interlocking member, and the second closure profile comprises a second sealing spaced between a third interlocking member and a fourth interlocking member. The first sealing member is sealingly engaged with the second sealing member, and the first and second interlocking members are interlocked with the third and fourth interlocking members, respectively. The first closure profile is continuously connected to the front panel between the first interlocking member and the second interlocking member, and the second closure profile is continuously connected to the back panel between the third interlocking member and the second sealing member. The second closure profile is not connected to the back panel proximate the fourth interlocking member.

Other aspects and advantages of the present invention will become apparent upon consideration of the following detailed description.

DETAILED DESCRIPTION

Figure 1:
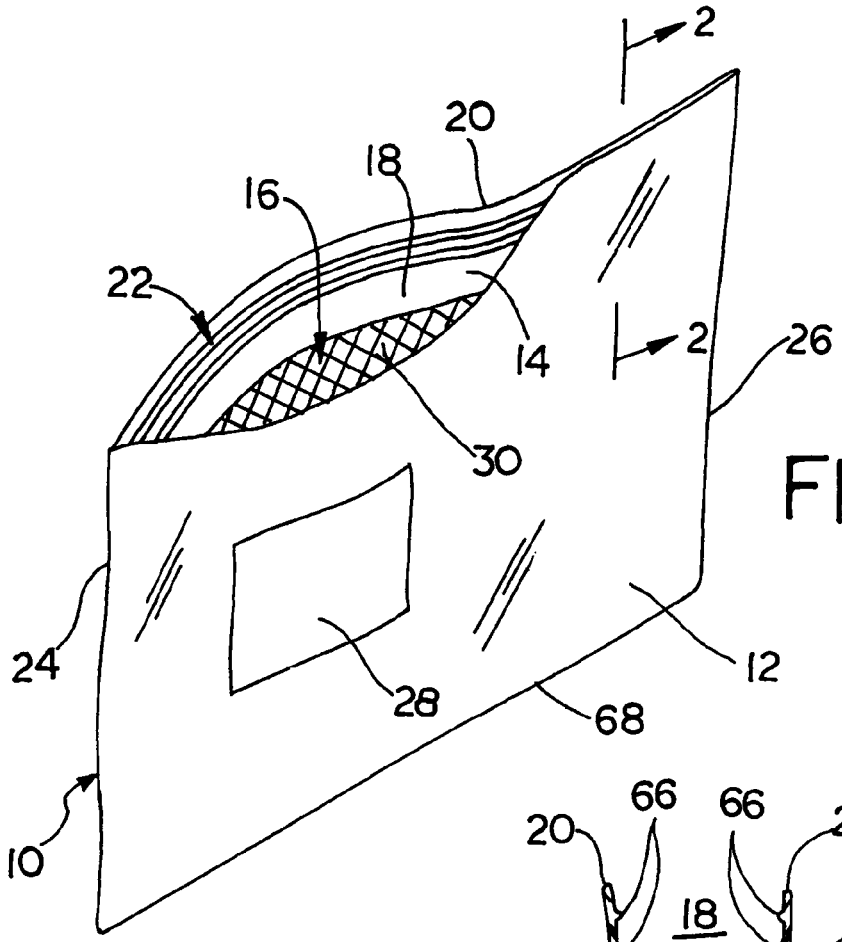
FIG. 1 is an isometric view of a pouch and an airtight closure mechanism according to one aspect of the present invention.
Figure 2:
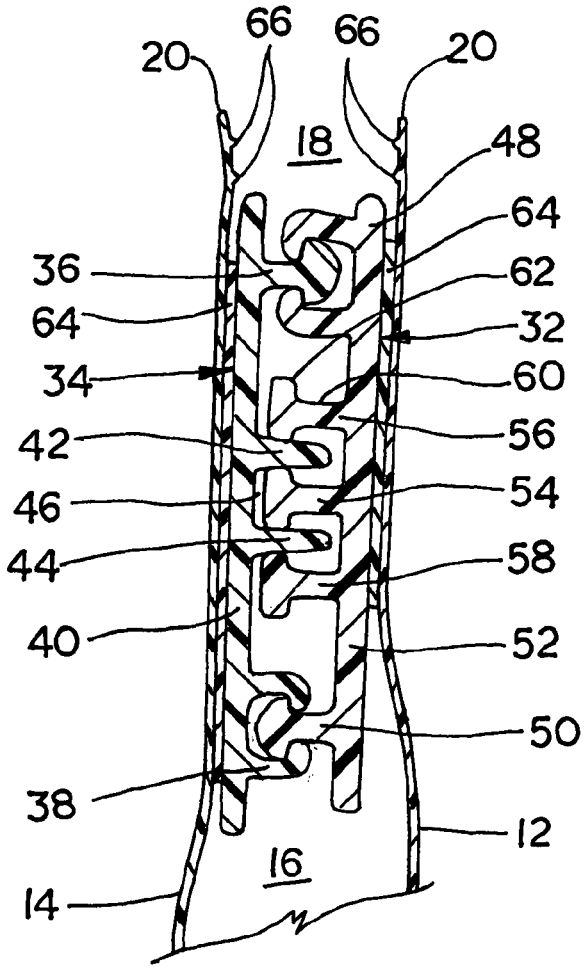
FIG. 2 is a partial cross-sectional view along the line 2-2 of FIG. 1 with portions behind the plane of the cross-section omitted for clarity.

As seen in FIGS. 1 and 2, a resealable pouch 10 includes a front panel 12 and a back panel 14 that are connected, such as by folding, heat seal, and/or adhesive, along three peripheral edges to define a sealable interior space 16 therebetween, and an opening 18 is defined along a top edge 20 where the front and back panels are not connected so as to allow access to the interior space. A resealable elongate closure mechanism 22 extends along the front and back panels 12, 14 near the opening 18 between a left edge 24 and a right edge 26 of the pouch 10 to allow the opening to be repeatedly sealed and unsealed, thereby closing and opening, respectively, the opening. Preferably, the closure mechanism 22 provides an airtight seal such that a vacuum may be maintained in the interior space 16 for an extended period of time, such as days, months, or years, when the closure mechanism is sealed fully across the opening 18. In one embodiment, the pouch 10 may include a second opening through one of the panels 12, 14 covered by a vacuum check valve 28 to allow air to be evacuated from the interior space 16 and maintain the vacuum when the closure mechanism 22 has been sealed. The pouch 10 may also include relief on or along an interior surface of one or both of the front and back panels 12, 14 to provide air flow channels 30 between the panels when a vacuum is being drawn through the check valve 28. In this manner, the pouch 10 provides a complete evacuable system within which food, for example, may be stored in a reusable vacuum pouch.

As best seen in FIG. 2, the closure mechanism 22 includes a closure element 32 that releasably interlocks and seals with an opposing closure element 34. Each closure element 32, 34 has a substantially constant elongate cross-sectional profile that extends longitudinally between the left edge 24 and right edge 26 of the pouch 10 to form a continuous seal therealong when fully interlocked with the opposing closure element. In one embodiment, closure element 32 is disposed along the front panel 12 and the closure element 34 is disposed along the back panel 14 opposite the first closure element so as to resealably interlock along an entire length thereof.

The closure element 34 has an elongate closure profile including a sealing section spaced between two interlocking members 36, 38, each projecting from a common side of a base member 40. In one embodiment, the interlocking member 36 has an arrow-shaped male interlocking profile, and the interlocking member 38 has a channel-shaped female interlocking profile. The arrow-shaped male interlocking profile 36 includes a shaft extending outwardly from the base member 40 and a symmetrical head with barbs extending from opposite sides of a distal end of the shaft spaced from the base member. The channel-shaped female interlocking profile 38 includes two spaced arms extending from the base member 40, each arm having an in-turned hook at a distal end thereof, to form a channel therebetween. The sealing section of the closure element 34 includes a sealing wall 42 and a sealing wall 44 spaced apart and projecting outwardly from the base member 40. The sealing walls 42, 44 in one embodiment are tapered, having a tip that is narrower than a base, thereby forming a tapered channel 46 therebetween. In one embodiment, the sealing walls 42, 44 and the male and female interlocking profiles 36, 38 are all approximately the same height from the base member 40.

The closure element 32 has an elongate second closure profile including a sealing section spaced between two interlocking members 48, 50, each projecting from a common side of a base member 52. In one embodiment, the interlocking member 48 has a channel-shaped female interlocking profile, and the interlocking member 50 has an arrow-shaped male profile, complementary with the respective male and female interlocking profiles 36, 38, respectively, of the closure profile 34. The sealing section of the closure element 32 includes at least one sealing rib that wedges into the tapered channel 46 between the opposing sealing walls 42, 44. In one embodiment, the sealing section includes a first sealing rib 54 disposed between a second sealing rib 56 and a third sealing rib 58. Each sealing rib 54, 56, 58 has a bulbous head 60, such as a cross member, spaced from the base member 52 proximate a distal end of a wall 62, which projects from the base member 52. In one embodiment, each sealing rib 54, 56, 58 has a T-shaped cross-section. In other embodiments, the bulbous head 60 may have other shapes that project laterally from the wall 62, such as rounded, asymmetrical, slanted, or multiple projections, for example.

In a sealed state, the male interlocking profile 50 is interlocked with the female interlocking profile 38, and the female interlocking profile 48 is interlocked with the male interlocking profile 36. The bulbous head 60 of the sealing rib 54 is wedged tightly into the tapered channel 46 against the sealing walls 42, 44. The sealing wall 42 is wedged tightly between and against the bulbous heads 60 of the sealing rib 54 and the sealing rib 56, and the sealing wall 44 is wedged tightly between and against the bulbous heads 60 of the sealing rib 54 and the sealing rib 58. Preferably, the geometry of the sealing walls 42, 44 and the sealing ribs 54, 56, 58 is such that, when the interlocking profiles 36, 38, 48, 50 are occluded together in the sealed state, the distal ends of the sealing walls are spaced from the base member 52 and the bulbous heads 60 are spaced from the base member 40, thereby ensuring four air tight seals across the closure profiles 32, 34 between the interlocking profiles 36, 48 and 38, 50. Further, the sealing sections are spaced from each interlocking member 36, 38, 48, 50, which provides a sealing section that forms an air tight seal independently of the interlocking members. Of course, more or fewer sealing walls and sealing ribs may be used in other embodiments to form more or fewer air tight seals across the closure profiles.

In order to develop differential opening and closing forces, one of the closure elements may be secured continuously to the respective panel along the entire profile of the base member, and the other closure element may be secured partially to the respective panel along only a portion of the profile. For example, in one embodiment, the closure element 34 is connected with the back panel 14 continuously between the interlocking member 36 and the interlocking member 38. The closure element 32 is connected with the front panel 12 continuously between the interlocking member 48 and an interior side of the sealing rib 58, and an interior end of the closure element 32 is unconnected with the front panel 12 between the interior end of the base 52 and the interior side of the sealing rib 58. In this manner, differential opening and closing forces may be developed because the interior end and interlocking profile 50 of the base 52 of at least the closure element 32 is allowed to hinge away from the front panel 12, thereby minimizing an opening force caused by the contents pushing outwardly against the front and back panels 12, 14. In other embodiments, the interior end of either or both closure profiles 32, 34 may be unconnected with the respective panel 12 or 14, or the interior end of both closure profiles may be connected with the respective panel.

The closure elements 32, 34 may be connected with the respective front and back panels 12, 14 by many means, such as with adhesives or heat or ultrasonic welding. In one embodiment, the closure elements 32, 34 are connected with the respective panels 12, 14 using an intermediate layer 64 of connecting material, such as thermoplastic weld material, disposed between and connecting the base member 40, 52 of the closure element with the respective panel 14, 12. In this embodiment, a hot layer of thermoplastic weld material 64 applied between each closure element 32, 34 and the respective panel 12, 14 melts and attaches to both the panel and the base member, thereby forming a thermoplastic weld therebetween, which in some embodiments may provide a good continuous air tight seal between each panel and the respective closure member.

In one embodiment, the top edge 20 of one or both of the front and back panels 12, 14 extends upwardly beyond an exterior end of the respective closure profile 32, 34. One or more grip ridges 66 project from an interior side of one or both of the panels 12, 14 between the top edge 20 and the respective closure member 32, 34 to provide additional finger traction for opening the closure mechanism.

In a further embodiment, one or both of the closure elements 32, 34 may include one or more textured portions, such as a bump or crosswise groove in one or both of the interlocking members 36, 48, in order to provide a tactile sensation, such as a series of clicks, as a user draws the fingers along the closure mechanism to signify sealing of the closure elements across the opening. In another embodiment, all of the closure elements 36, 38, 48, 50 include textured portions along the length of the profile to provide tactile and/or audible sensations when closing the closure mechanism 22.

In one embodiment, the front and back panels 12, 14 and closure mechanism 22 are formed by known extrusion methods. For example, the panels 12, 14 may be extruded of thermoplastic material as a single continuous single- or multiply web, and the closure profiles 32, 34 may be extruded of the same or different thermoplastic material separately as continuous lengths or strands. The panels 12, 14 in one embodiment may be formed of multi-layer air impermeable film, such as an EVOH ply adhesively secured between polypropylene and low density polyethylene plies. One panel, such as the back panel 14, may be embossed or otherwise textured with a pattern, such as a diamond pattern, on both sides spaced between a bottom edge 68 and the closure mechanism 22 and may have a smooth area adjacent the bottom edge and top edge. The closure elements in one embodiment 32, 34 may be extruded primarily of molten polyethylene with various amounts of slip component, colorant, and talk additives in a separate process. The fully formed closure profiles 32, 34 may then be attached along opposite edges of one side of the web by placing or extruding a strip of molten thermoplastic weld material 64 onto the web along or adjacent to each edge of the web and immediately placing a closure member 32, 34 onto each strip of molten thermoplastic weld material. The thermoplastic weld material 64 may then be allowed to cool, the web folded together between the two edges to place the closure members 32, 34 in opposing resealable relation, and the web severed transverse to the web direction into discrete pouches, in a manner well known in the art, to form the pouch 10. According to another embodiment, the web, intermediate layer of connecting material 64, and the closure elements 32, 34 may be extruded together simultaneously, and subsequently cooled, folded, and cut. If used, the check valve 28 may be formed on and/or attached to the web prior to folding.

Of course, various details shown in FIGS. 1 and 2 may be modified within the spirit of the present invention. For example, the specific orientation of the closure profiles 32, 34 with respect to the interior 16 may be altered from the orientation shown in the drawings, such that, for example, the male interlocking profile 36 and the female interlocking profile 48 may be disposed on the interior side 16 of the sealing sections. In addition, the location and/or use of the check valve 28 and the air flow channels 30 may be modified as desired. Other methods and materials suitable for forming structures of the present invention may be also be used.

INDUSTRIAL APPLICABILITY

A pouch according to the present invention may be used to pack and store perishable items contained therein in an air-free or vacuum environment. According to one embodiment, the closure mechanism of the present invention can provide an air tight seal that is separate from the interlocking members so as to provide a more secure air tight seal. Clearly, many other and varied uses of the pouch and closure mechanism disclosed herein are also possible.

Numerous modifications to the present invention will be apparent to those skilled in the art in view of the foregoing description. Accordingly, this description is to be construed as illustrative only and is presented for the purpose of enabling those skilled in the art to make and use the invention and to teach the best mode of carrying out same. The exclusive rights to all modifications which come within the scope of the appended claims are reserved.

We claim:

1. An airtight resealable closure mechanism having an elongate profile extending between a first end and a second end, the profile comprising:

a first closure element having a first interlocking member, a second interlocking member, and a first sealing member, each protruding from a first base member, wherein the first sealing member is disposed between the first and second interlocking members; and a second closure element having a third interlocking member, a fourth interlocking member, and a second sealing member, each protruding from a second base member, wherein the second sealing member forms a tapered channel and is disposed between the third and fourth interlocking members;

wherein the first and second interlocking members are resealably interlocked with the third and fourth interlocking members, respectively;

wherein the first sealing member is wedged into the tapered channel of the second sealing member, whereby an airtight seal is formed; and wherein the first and second sealing members are spaced from each of the first, second, third, and fourth, interlocking members.

2. The resealable elongate closure mechanism of claim 1, wherein each of the first and fourth interlocking members comprises a pair of arms forming a channel-shaped female interlocking member, and wherein each of the second and third interlocking members comprises an arrow-shaped interlocking member.

3. The resealable elongate closure mechanism of claim 1, wherein the first sealing member comprises a first rib disposed between a second rib and a third rib, wherein the first rib includes a bulbous head, and wherein the bulbous head wedges within the tapered channel.

4. The resealable elongate closure mechanism of claim 3, wherein the second sealing member comprises a first wall spaced from a second wall to form the tapered channel therebetween, wherein the first wall is disposed between the first rib and the second rib, and the second wall is disposed between the first rib and the third rib.

5. The resealable elongate closure mechanism of claim 4, wherein each of the second rib and the third rib includes a bulbous head, wherein the first wall wedges between the bulbous heads of the first and second ribs and the second wall wedges between the bulbous heads of the first and third ribs.

6. The resealable elongate closure mechanism of claim 5, wherein each of the first, second, and third ribs is T-shaped.

7. The resealable elongate closure mechanism of claim 1, wherein the first and second closure elements comprise thermoplastic.

8. A resealable airtight closure mechanism comprising:

a first elongate profile resealably interlocked with a second elongate profile, wherein each elongate profile extends longitudinally between two ends;

the first profile comprising a first sealing wall spaced between an arrow-shaped first male interlocking member and a channel-shaped first female interlocking member, each projecting from one side of a first base member; and the second profile comprising a first sealing rib and a second sealing rib spaced between a channel-shaped second female interlocking member and an arrow-shaped second male interlocking member, each projecting from one side of a second base member, wherein each sealing rib comprises a bulbous head spaced from the second base member;

wherein the first male interlocking member is interlocked with the second female interlocking member and the first female interlocking member is interlocked with the second male interlocking member, and wherein the sealing wall is wedged between the first sealing rib and the second sealing rib, wherein an airtight seal is formed between the sealing wall and each bulbous head.

9. The resealable airtight closure mechanism of claim 8, wherein each bulbous head comprises a lateral member projecting outwardly from the sealing rib toward the sealing wall.

10. The resealable airtight closure mechanism of claim 8, wherein the sealing ribs are spaced between the first male interlocking member and the first female interlocking member.

11. The resealable airtight closure mechanism of claim 8, the first profile further comprising a second sealing wall extending from the side of the first base member between the first male interlocking member and the first female interlocking member, wherein the first and second sealing walls define a tapered channel therebetween, and wherein the bulbous head of the first sealing rib is wedged between the first and second sealing walls.

12. The resealable airtight closure mechanism of claim 11, the second profile further comprising a third sealing rib spaced between the second male interlocking profile and the second female interlocking profile, the third sealing rib comprising a bulbous head spaced from the second base member, wherein the first sealing wall is wedged between the first sealing rib and the second sealing rib, and the second sealing wall is wedged between the first sealing rib and the third sealing rib, whereby a first airtight seal is formed between the first sealing wall and the bulbous heads of the first and second sealing ribs and a second airtight seal is formed between the second sealing wall and the bulbous heads of the first and third sealing ribs.

13. The resealable airtight closure mechanism of claim 12, wherein the first sealing rib comprises a wall extending from the second base member and the bulbous head comprises a cross-beam disposed generally perpendicular to the wall proximate a distal end of the wall opposite the second base member.

14. The resealable airtight closure mechanism of claim 13, wherein each of the sealing ribs comprises a T-shaped member.

* * * * *